United States Patent [19]

Takubo

[11] 4,383,393

[45] May 17, 1983

[54] AUTOMATIC LENS GRINDING MACHINE

[76] Inventor: Takamasa Takubo, No. 15-1, 2-chome,, Hokima, Adachi-ku Tokyo-to, Japan

[21] Appl. No.: 230,713

[22] Filed: Feb. 2, 1981

[30] Foreign Application Priority Data

Feb. 13, 1980 [JP] Japan ..... 55-16418

[51] Int. Cl.[3] ..... B24B 9/14

[52] U.S. Cl. ..... 51/101 LG

[58] Field of Search ..... 51/101 LG, 101 R, 124 L

[56] References Cited

U.S. PATENT DOCUMENTS

| | | | |
|---|---|---|---|
| 3,513,598 | 5/1970 | Asselin | 51/101 LG |
| 3,745,720 | 7/1973 | Savage | 51/101 LG |
| 3,894,361 | 7/1975 | Georgiadis | 51/101 LG |
| 4,157,636 | 6/1979 | Wrigglesworth | 51/101 LG |
| 4,176,498 | 12/1979 | Uulich | 51/101 LG |

FOREIGN PATENT DOCUMENTS

| | | |
|---|---|---|
| 50-52695 | 5/1975 | Japan . |
| 51-14318 | 5/1976 | Japan . |
| 2041800 | 9/1980 | United Kingdom . |

*Primary Examiner*—Harold D. Whitehead

*Attorney, Agent, or Firm*—Scrivener, Clarke, Scrivener and Johnson

[57] ABSTRACT

An automatic grinding machine adapted to form a desired profile of the peripheral ridge of a spectacle lens which mates with the profile of the lens receiving groove of a spectacle frame. During the semi-finishing grinding step, the peripheral edge of the spectacle lens is ground by a semi-finishing grinding wheel whose outer cylindrical surface is formed with a V-shaped circumferential groove having a width greater than the thickness of the spectacle lens at the peripheral edge thereof, so that the axial center of the spectacle lens may be automatically aligned with that of the semi-finishing grinding wheel by the self-alignment action due to the contact of the peripheral edges of the spectacle lens with the inclined surfaces of the V-shaped groove. The self-alignment action; that is, the axial movement pattern of the spectacle lens during the semi-finishing step is stored and then reproduced during the finishing step, whereby the axial center of the lens may be also automatically aligned with that of the finishing grinding wheel.

1 Claim, 6 Drawing Figures

FIG.5(a)
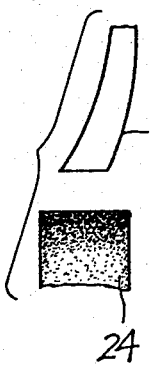
FIG.5(b)
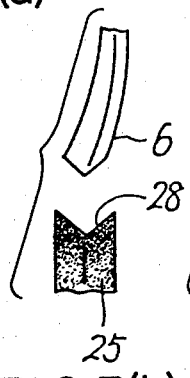
FIG.5(c)
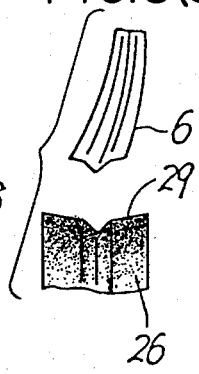
FIG.5(d)
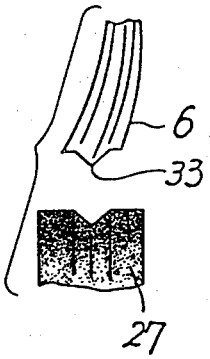
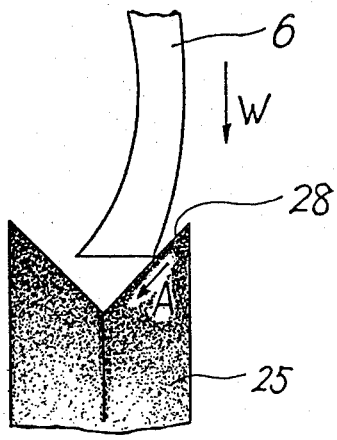
FIG. 6

AUTOMATIC LENS GRINDING MACHINE

BACKGROUND OF THE INVENTION

The present invention relates to an automatic grinding machine adapted to grind the peripheral edge of a spectacle lens to a desired profile.

In order to fit the spectacle lenses into a spectacle frame, the peripheral edge of the lens must be ground to a profile which mates with that of the lens receiving groove of the frame. In general, the lenses have two spherical surfaces and are not circular in shape. As a result, both the axial and radial positions of the lens periphery change as the spectacle lens is rotated. Furthermore the axial and radial positions of the lens periphery also vary depending upon lens sizes and lens curves. In grinding the peripheral edge of a spectacle lens, it is necessary to maintain the peripheral edge at the plane passing the axial center of a grinding wheel perpendicular to the axis thereof.

Some reasons why the axial and radial positions of the peripheral edge of a spectacle lens are variable upon rotation of the lens will be explained below.

(I) Since the spectacle lenses have spherical surfaces as described above, the axial and radial positions of the peripheral edge of a spectacle lens are dependent upon the curvatures of the spherical surfaces which in turn are dependent upon a desired refractive power. In like manner, the thickness of a spectacle lens varies depending upon a desired refractive power, which is accompanied with the variation in curvature of the center of the lens in the direction of its thickness.

(II) The axial and radial positions of the peripheral edge of a spectacle lens vary depending upon the shape of the lens; that is, depending upon whether the lens is elliptical or rectangular in shape. They also change depending upon the size.

(III) With the conventional lens grinding machines, a spectacle lens is held or clamped by a pair of clamping or chucking pads carried by a stationary shaft and a movable shaft, respectively. As a result, the center of the lens in the direction of its thickness (to be referred to as the "axial center" in this specification for brevity) changes or is shifted by a distance equal to one half of the variation in thickness of the lens, which causes the change in position of the peripheral edge of the lens.

(IV) In order to hold a spectacle lens to be ground without causing surface flaws chucking pads made of rubber are used. As a result, the degree of deformations of the chucking pads varies depending upon the chucking forces applied to them so that the position of the peripheral edge of the lens is deviated.

(V) When the centers of the chucking pads are out of alignment with the optical center of a spectacle lens to be ground, nonuniform or unsymmetrical deformations of the chucking pads result. As a result, the lens is eccentrically rotated because the optical center of the lens is eccentric from the axis of rotation so that the axial and radial positions of each point on the peripheral edge of the lens are deviated from the normal positions.

The lens curve (i.e., the curve of the axial center) of a spectacle lens is sometimes different from the grinding curve (i.e., the curve of the grinding center). The lens curves are varied depending upon the purposes of the spectacle lenses used. However almost all the spectacle frames are fabricated to mount spectacle lenses with a predetermined lens curve from the standpoint of fabrication steps. As a result, when a spectacle lens has a lens curve different from the curve of the lens receiving groove of a spectacle frame, the grinding curve must be shifted from the lens curve.

In the conventional grinding machines for grinding the peripheral edge of a spectacle lens to a desired profile, a pair of lens chucking heads are so arranged as to move in both the axial and radial directions of the lens chucked. Axial and radial templates or master cams are provided so that the axial and radial movements of the lens being ground may be constrained when the peripheral edge of the lens is made into contact with the grinding wheel mounted on a stationary wheel head.

However, the adjustment in relative position between the lens to be ground and the templates or master cams is very difficult because the lens must be exactly aligned with the axial and radial templates or master cams. As described at (III), the position of the pair of lens chucking heads varies from one spectacle lens to another. As a result, the axial position of the lens chucking heads must be adjusted from one lens to another. In addition, in the case of (V), the optical axis of a spectacle lens to be ground must be correctly aligned with the axis of rotation, which is very complicated. Moreover when the spectacle lenses are in the same shape but their lens curve and thickness vary, the corresponding master cams must be selected and mounted.

The present invention therefore has for its object to provide an automatic lens grinding machine which can substantially overcome the above and other problems encountered in the prior art lens grinding machines and which can grind spectacle lenses very efficiently.

The above and other objects, effects and features of the present invention will become more apparent from the following description of one preferred embodiment thereof taken in conjunction with the accompanying drawings.

BRIEF EXPLANATION OF THE DRAWINGS

FIG. 5 is a view used for the explanation of the steps of grinding the peripheral edge of a spectacle lens by the grinding machine of the present invention shown in FIGS. 1 through 3; and FIG. 6 is a view used for the explanation of the self-alignment action between the spectacle lens and a semi-finishing grinding wheel.

DETAILED DESCRIPTION OF THE PREFERRED EMBODIMENT

Figure 1:
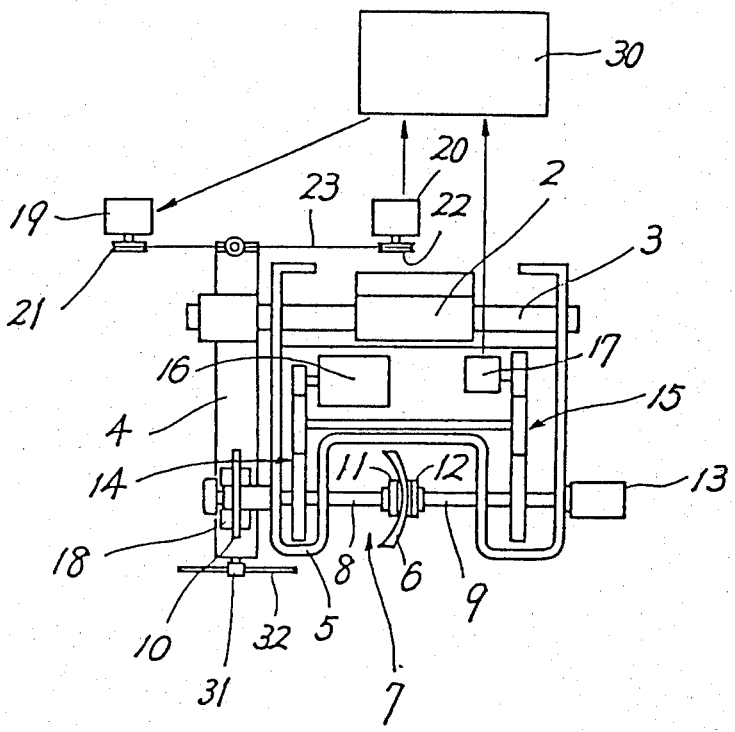
FIG. 1 is a schematic top view of an automatic lens grinding machine in accordance with the present invention.
Figure 2:
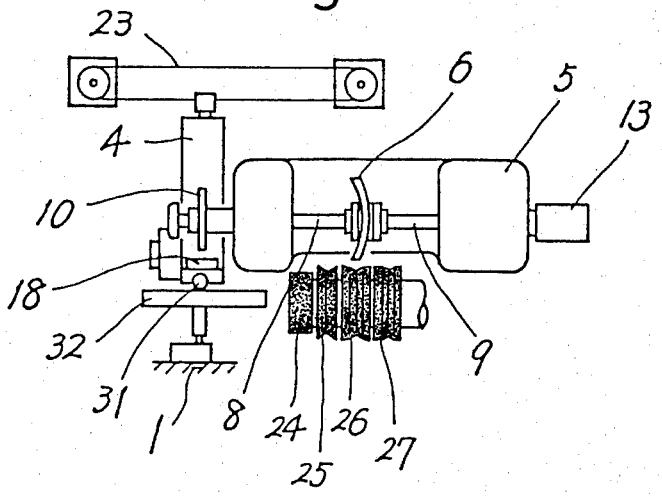
FIG. 2 is a schematic front view thereof.
Figure 3:
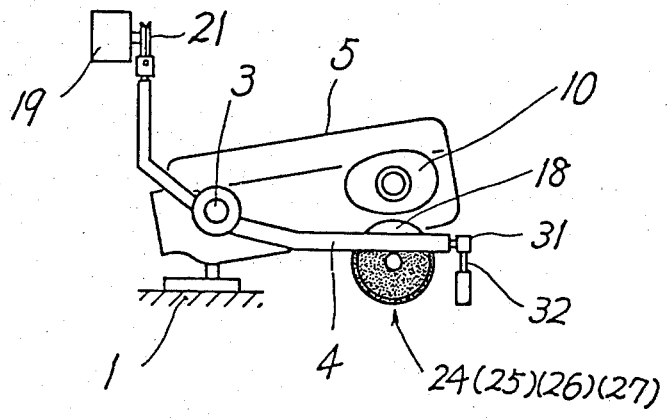
FIG. 3 is a schematic side view thereof.

Referring first to FIGS. 1 through 3 a horizontal shaft 3 is supported by a bearing 2, which is rigidly secured to a base 1, in such a way that the shaft 3 may be slidable in the axial (horizontal) direction. A level arm 4 is securely fastened to the shaft 3 and a head frame 5 is swingably mounted on the shaft 3. The head frame 5 is formed with a recess 7 in which is chucked a lens 6 to be ground. A pair of chuck shafts 8 and 9 are extended horizontally through the recess 7. The chuck shaft 8 (the left one in FIG. 1) closer to the level arm 4 is rotatably mounted and a template or master cam 10 which defines the shape of the lens 6 in its radial direction is removably mounted on the shaft 8 at the outer end (the left end in FIG. 1) thereof. A chuck head 11 is mounted on the shaft 8 at the inner end (the right end in FIG. 1) thereof.

As best shown in FIG. 3, a tracing disk or a cam follower 18 having the outer diameter equal to that of a grinding wheel to be described below is mounted on the level arm 4 and is made into contact with the template 10 during grinding operations so that as the chuck shafts 8 and 9 are rotated, the head frame 5 is caused to shift vertically or to swing about the axis of the shaft 3 depending upon the cam profile of the template 10.

Referring back to FIGS. 1 and 2, the shaft 9 is rotatably and axially movably mounted and a chuck head 12, which coacts with the chuck head 11, is mounted at the inner end of the shaft 9. The outer end of the shaft 9 is connected to an actuator 13 such as an air cylinder in such a way that when the actuator 13 is energized, the shaft 9 is caused to slide axially in either direction. The shaft 8 is drivingly coupled through a gear train 14 to a motor 16 and the shaft 9 is operatively coupled through another gear train 15 to a first pulse encoder 17 which is adapted to detect the angle of rotation of the lens 6 clamped between the chuck heads 11 and 12. Both the drive motor 16 and the pulse encoder 17 are mounted on the head frame 5 and therefore are moved in unison therewith.

A stepping motor 19 which is adapted to horizontally drive the head frame 5 and a second pulse encoder 20 which is adapted to detect the horizontal or axial position of the lens being ground are mounted on the base 1 in such a way that the imaginary line interconnecting them may be in parallel with the axis of the shaft 3. The stepping motor 19 is operatively coupled to the second pulse encoder 20 with an endless belt 23 which is wrapped partically around a pulley 21 carried by the shaft of the stepping motor 19 and a pulley 22 carried by the shaft of the second pulse encoder 20. The rear end (the upper end in FIG. 1) of the level arm 4 is securely fastened to the endless belt 23. The pulley 21 is mounted in such a way that when the stepping motor 19 is energized, the pulley 21 is rotated stepwise in unison with the shaft of the motor 19, but when the stepping motor 19 is de-energized, the pulley 21 may freely rotate.

A plurality of grinding wheels 24, 25, 26 and 27 are mounted below the pair of chucking heads 11 and 12 on a shaft which is rotated by a suitable driving means (not shown). A special profile, which corresponds to the desired profile of the peripheral edge of the glass lens 6, is formed on the outer cylindrical surface of each grinding wheel. For instance, the first grinding wheel 24, which is adapted for coarse grinding, has a flat outer cylindrical surface, but the second and third grinding wheels 25 and 26, which are adapted for semi-finishing grinding, have the outer cylindrical surfaces each formed with a circumferential groove having V-shaped inclined surfaces the width of which is greater than thickness of the spectacle lens. The fourth grinding wheel 27, which is adapted for finishing grinding, have the outer cylindrical surface formed with a circumferential groove whose profile corresponds to that of the groove of a spectacle frame into which is fitted the finished lens. (See FIG. 5.)

The first and second pulse encoders 17 and 20 and the stepping motor 19 are operatively coupled to a control unit 30 including a storage means (a microcomputer) and a drive circuit. The control unit 30 stores the outputs from the first and second encoders 17 and 20 and drives the stepping motor 19 in response to these outputs.

The front end of the level arm 4 carries a roller 31 which in turn rides on a guide rail 32.

Figure 4:
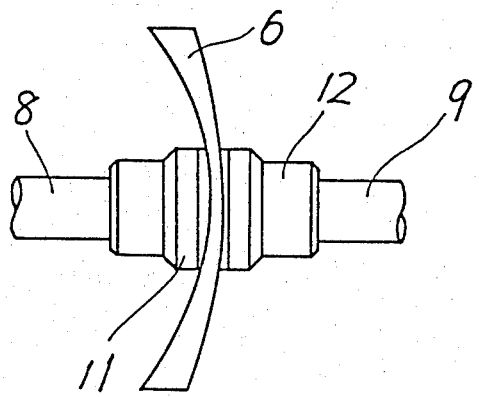
FIG. 4 shows, on enlarged scale, a spectacle lens held by a pair of lens chucking heads.

Next the mode of operation of the automatic lens grinding machine with the above construction will be described with further reference to FIGS. 4 through 6. First the master cam 10 whose cam profile corresponds to the desired profile of the peripheral edge of the lens 6 is mounted on the chuck shaft 8. Next the lens 6 to be ground is clamped with the pair of chuck heads 11 and 12 in such a way that the lens 6 may be in the same posture with that of the master cam 10, that the lens 6 and the master cam 10 may be maintained in coaxial relationship and that the axial center of the lens 6 may be almost exactly aligned with that of the first or coarse preliminary grinding wheel 24. The lens driving motor 16 is energized and the grinding wheel driving motor (not shown) is also energized so that the lens 6 and the coarse grinding wheel 24 rotate. The rotating lens 6 is brought into contact with the coarse grinding wheel 24. (Under these conditions the master cam 10 is also made into contact with the tracing disk 18.) As the lens 6 is raised or lowered depending upon the cam profile of the master cam 10, the peripheral edge of the lens 6 is ground flat as shown at (a) in FIG. 5. In this case, depending upon the shape and position of the lens 6, the latter is caused to vibrate in the horizontal or axial direction, but this vibration can be compensated for by using the coarse grinding wheel having the grinding surface the width in the axial direction of which is greater than the amplitude of the vibrations of the lens 6.

After the coarse grinding has been completed, a control means (not shown) is actuated so that the lens 6 is separated from the coarse grinding wheel 24 and then the stepping motor 19 is energized so that the head frame 5, which is drivingly coupled to the stepping motor 19 through the endless belt 23, the level arm 4 and the shaft 3, is shifted horizontally or axially to the left in FIG. 1 by the distance equal to the spacing between the coarse grinding wheel 24 and the semi-finishing grinding wheel 25. Alternatively, the head frame 5 may be shifted manually. After the lens 6 has been positioned in the manner described above, the control unit 30 is reset and the stepping motor 19 is de-energized so that the head frame 5 may move freely in the horizontal or axial direction with respect to the reference point which is the position of the lens 6 set as described above. Thereafter the lens 6 is made into contact with the semi-finishing grinding wheel 25 under its own weight and then the semi-finishing grinding is started. When the axial center of the lens 6 is not aligned with that of the semi-finishing grinding wheel 25, one edge of the lens 6 firstly contacts one inclined surface 28 of the V-shaped groove of the grinding wheel 25 as shown in FIG. 6. The lens 6 is always pressed against the grinding wheel 25 under its weight W as well as the weight of the head frame 5 and the head frame 5 is freely movable in the horizontal or axial direction as described above. As a result, the lens 6 slides down over the inclined surface 28 as indicated by an arrow A until the axial center of the lens 6 is made into alignment with that of the semi-finishing grinding wheel 25. To put in another way, the lens 6 is always moved in the axial or horizontal direction as edges of the lens 6 slide down along the inclined grinding surfaces of the V-shaped groove of the grinding wheel 25 so that the axial center of the lens 6 may be aligned with that of the grinding wheel 25.

The axial shift of the head arm 5 is transmitted through the level arm 4 and the endless belt 23 to the second pulse encoder 20 and the output from the pulse encoder 20 is delivered to the control unit 30. The angle of rotation of the lens 6 being ground is detected by the first pulse encoder 17 and delivered to the control unit 30. In response to these two inputs, the control unit 30 stores not only the error in alignment between the axial centers of the lens 6 and the grinding wheel 25 but also the change in the axial position of the lens 6 as a function of the angle of rotation thereof. After the semi-finishing grinding of the lens 6 with the grinding wheel 25 has been completed, the lens 6 is separated from the grinding wheel 25 and then the stepping motor 19 is energized again so that the head frame 5 and hence the lens 6 are moved to the right in FIG. 2 by a distance equal to the spacing between the axial centers of the semi-finishing and finishing grinding wheels 25 and 27. In this case, the stepping motor 19 rotates stepwise through a predetermined angle in response to the control pulse from the control unit 30 so that the lens 6 is shifted in the manner described above.

In response to the control pulses from the control unit 30 which has stored the pattern of axial movement made by the lens 6 during the semi-finishing step by the grinding wheel 25, the stepping motor 19 reproduces the same axial movement of the lens 6 while the latter is rotated during the finishing step by the finishing grinding wheel 27, whereby the peripheral ridge 33 is formed which snugly mates with the lens receiving groove of the spectacle frame.

Sometimes it occurs that the lens curve does not coincide with the curve of the lens receiving groove of the spectacle frame. In this case, the curve of the lens receiving groove is previously entered into the control unit 30. In operation, in response to the previously stored data representative of the curve of the lens receiving groove and to the outputs from the first and second pulse encoders 17 and 22, the control unit 30 delivers the control pulses to the stepping motor 19 so that the head frame 5 and hence the lens 6 may traverse according to the curve of the lens receiving groove and consequently the finished peripheral ridge 33 may exactly coincide with that of the lens receiving groove.

So far the semi-finishing grinding wheel 25 has been described as having a V-shaped profile 28, but it is to be understood that the semi-finishing grinding wheel may have any desired profile as shown at (c) in FIG. 5.

The first pulse encoder 17 for detecting the angle of rotation of the lens 6 may be directly connected to the output shaft of the motor 16 for rotating the lens 6. Instead of the second pulse encoder 22 for detecting the axial position of the lens 6, any suitable means such as a magnet scale capable of detecting the axial position of the lens 6 may be employed. In addition, various modifications can be effected without departing the true spirit of the present invention.

In summary, according to the present invention, the time required for holding the lens in operative position can be considerably reduced. In addition, the step for tracing the template or master cam can be much simplified so that even an unskilled operator can exactly finish a desired peripheral ridge of the lens. Moreover, the coarse, semi-finishing and finishing grinding steps can be automatically and sequentially accomplished so that a higher degree of efficiency can be ensured. Furthermore, even when the lens curve does not coincide with the curve of the lens receiving groove of the spectacle frame, the peripheral ridge of the lens can be automatically formed which exactly mates with the lens receiving groove.

What is claimed is:

1. An automatic lens grinding machine comprising a head frame having a chuck means for holding and rotating a spectacle lens to be ground, said head frame being adapted to move both axial and radial directions of said spectacle lens, and a group of at least a coarse grinding wheel, a semi-finishing grinding wheel and a finishing grind wheel, an outer surface of said semi-finishing grinding wheel being formed with a circumferential groove with inclined grinding surfaces the width of which is greater than thickness of the spectacle lens at its peripheral edge, whereby an axial center of said spectacle lens can be aligned with that of said semi-finishing grinding wheel by self-alignment action due to the contact of said peripheral edge of said spectacle lens with said inclined grinding surfaces of said circumferential groove of said semi-finishing grinding wheel, a motor adapted to be selectively operatively connected to said head frame for traversing said head frame and hence said spectacle lens to be ground relative to said grinding wheel group, an angular position detecting means for detecting an angle of rotation of said spectacle lens, an axial movement detecting means for detecting an axial movement of said head frame, and a control means responsive to outputs from said angular position and axial movement detecting means for storing a pattern of axial movement of said head frame due to said self-alignment action as a function of the angular position of said spectacle lens during semi-finishing step by said semi-finishing grinding wheel and, during finishing step by said finishing grinding wheel, controlling said motor so that said pattern of axial movement of said head frame can be reproduced.

* * * * *